US005235668A

United States Patent [19]

Koponen

[11] Patent Number: 5,235,668

[45] Date of Patent: Aug. 10, 1993

[54] PORTABLE ELECTRIC SPACE HEATER WITH AIR COOLED OUTER WALL SURFACES

[76] Inventor: Laila T. Koponen, Kuukkelintie 13 E, 96400 Rovaniemi, Finland

[21] Appl. No.: 925,021

[22] Filed: Aug. 5, 1992

[30] Foreign Application Priority Data

Aug. 13, 1991 [FI] Finland ..... 913824

[51] Int. Cl.[5] ..... F24H 3/00; F24H 9/02

[52] U.S. Cl. ..... 392/373; 392/342; 392/374

[58] Field of Search ..... 219/372, 373, 342, 347, 219/374

[56] References Cited

U.S. PATENT DOCUMENTS

| | | | |
|---|---|---|---|
| 3,337,715 | 8/1967 | Finn | 392/374 X |
| 3,400,248 | 9/1968 | Isomaa | 392/373 |
| 3,530,277 | 9/1970 | Kujansuu | 392/342 X |
| 3,531,623 | 9/1970 | Teeri | 392/342 X |

FOREIGN PATENT DOCUMENTS

| | | | |
|---|---|---|---|
| 605233 | 7/1948 | United Kingdom | 392/373 |

*Primary Examiner*—Anthony Bartis
*Attorney, Agent, or Firm*—Larson and Taylor

[57] ABSTRACT

An electric heater with thermal self-circulation of the room-air which is heated by means of electric resistors (7) placed in the core (6) of the heater. The heater is made of three or four casing elements (1) at the corners of which vertical gables (2) form frames for air slots (3) through which some of the room-air flows into the heater where a vertical separation wall (4) partly conducts air through air slots (5) between metal sheets (9A) and (9B) to the core (6) of the heater and partly to the channel (8) between casing element (1) and metal sheets (9A) and (9B) which is open at its upper and lower end to vertical air-flow on the outside around the core (6) when electric resistors (7) are activated for cooling the outer wall surfaces of the heater.

2 Claims, 2 Drawing Sheets

PORTABLE ELECTRIC SPACE HEATER WITH AIR COOLED OUTER WALL SURFACES

This invention relates to an electric heater with a system of thermal self-circulation of the room-air heated by electric resistors and metal sheets in the heater core which are warmed by radiant heat and disperse the effect of the radiant heat towards the sheet casing of the heater. All previously known heaters for room-air heating have the common disadvantage that the outer surface of the heater casing can cause health trouble at home or at work and, furthermore, placing of the heater in the dwelling environment is complicated.

The object of the invention is to provide an electric heater with a cooled outer surface fit for industrial series production, which does not require much space and is at the same time adaptable to the environment and different ranges of use where heating is needed.

According to the invention, the heater is comprised of at least three vertical casing elements which are spaced apart to create open corner air slots. Inner walls are joined to the elements at vertical edges to form air flow passages therebetween. The inner walls comprise sheets having horizontally adjacent edges offset to form slots through which air flows into the passages. Vertical baffles at the open corner air slots divert air into the passages.

In order to achieve this object the invention is characterized by the features described in the following patent claims. In the following embodiment of the invention is described with reference to the enclosed drawings, where FIG. 1 shows an electric heater as per the invention.

Figure 1:
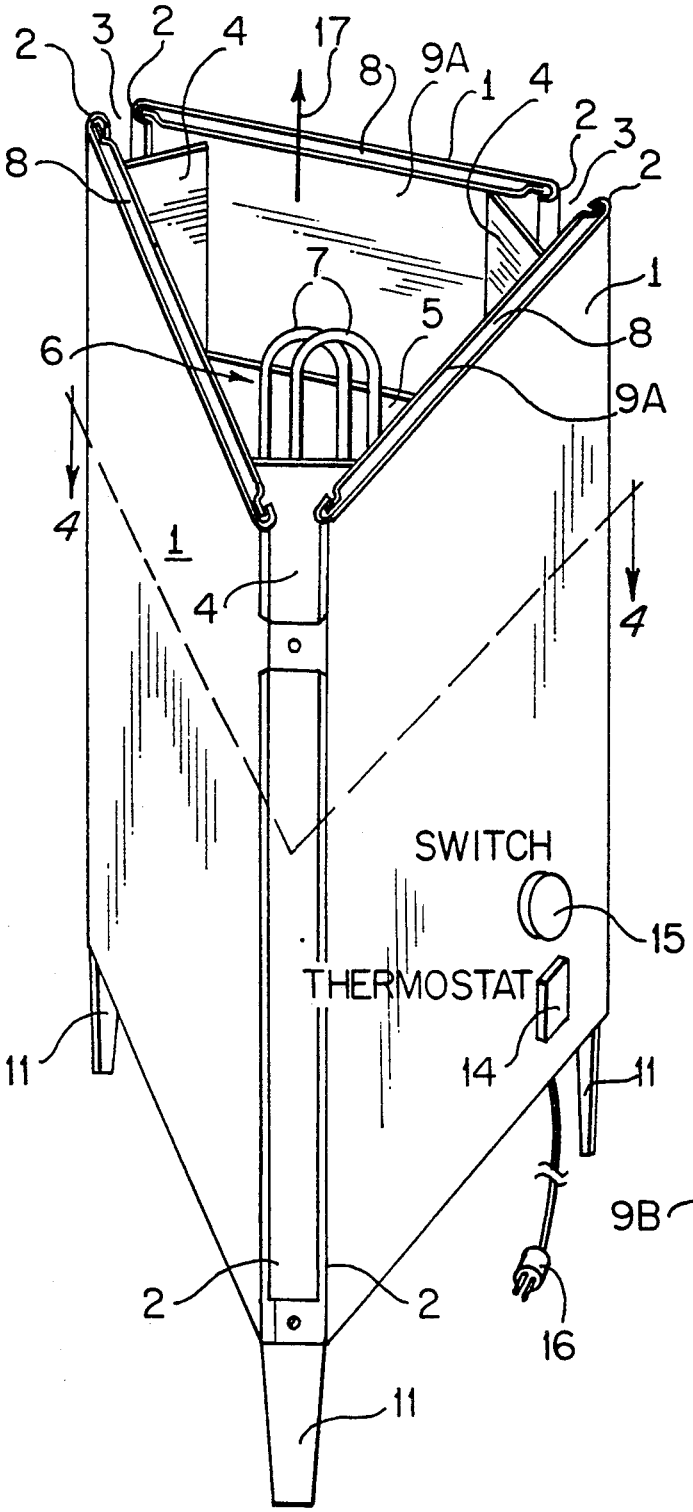
Figure 2:
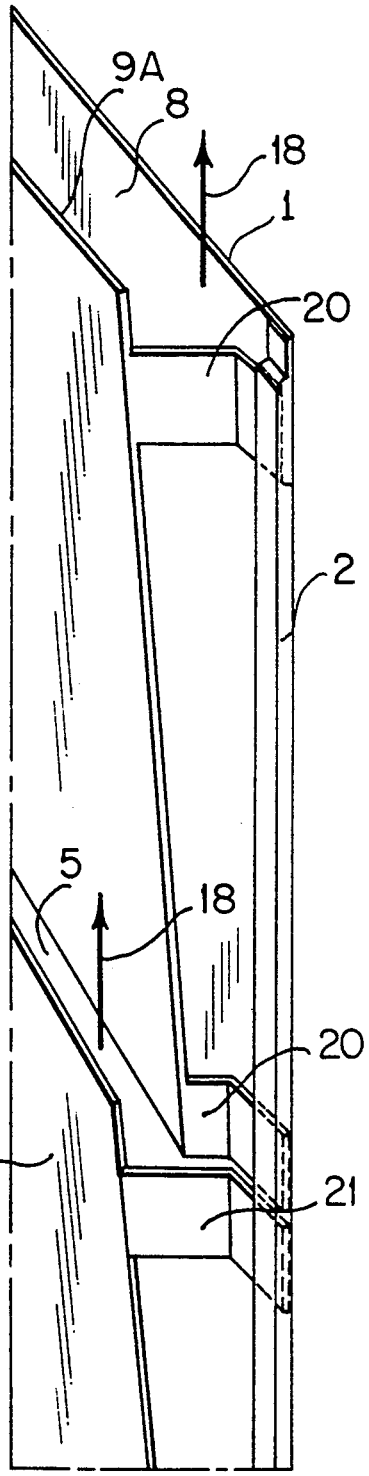
FIG. 2 shows a detail on the upper part of the corner gable of the electric heater in FIG. 1.
Figure 3:
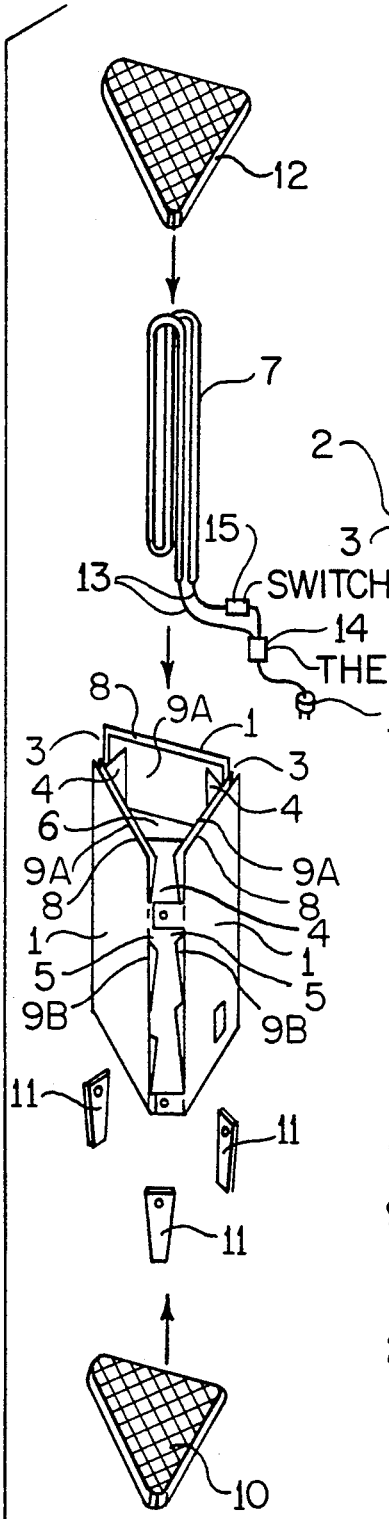
FIG. 3 shows an assembly of the electric heater in FIG. 1.
Figure 4:
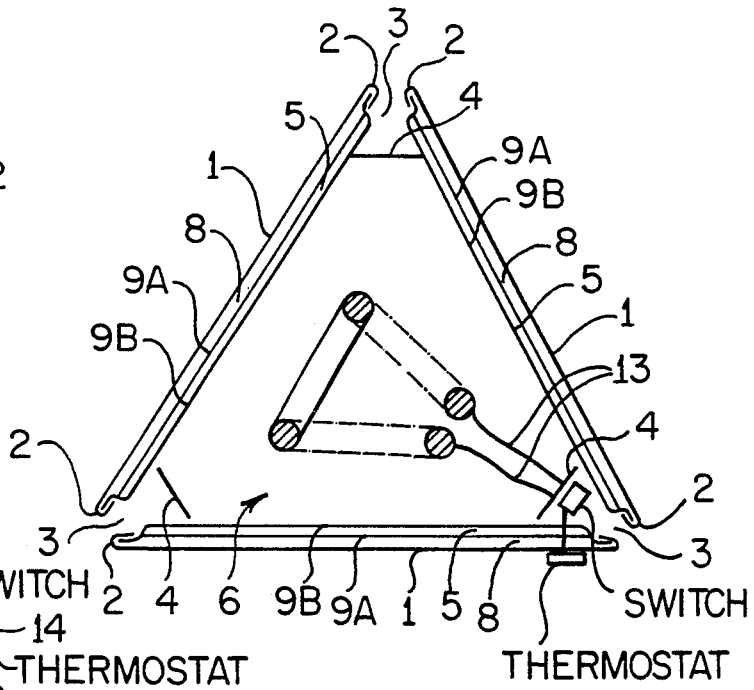
FIG. 4 shows a horizontal cross-section taken along the line 4—4 of the electric heater in FIG. 1.
Figure 5:
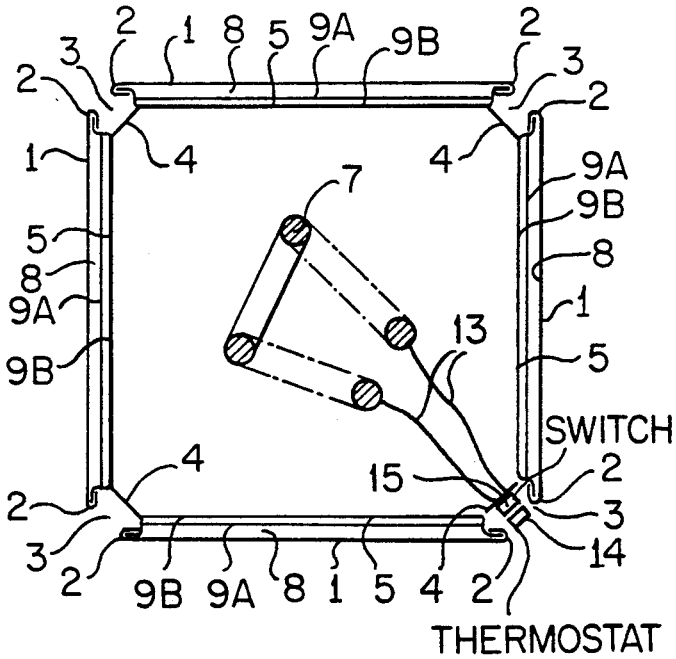
FIG. 5 shows a horizontal cross-section of a heater with four sides as per the invention.

The electric heater is comprised of three of four casing elements (1) where the vertical gables (2) form frames for air slots (3) through which some of the room-air flows into the heater where the vertical separation wall (4) partly conducts the air through upper and lower sheets (9A) and 9B, respectively, having their adjacent edges offset to form air slots (5) and to the core (6) of the heater and partly to channel (8) between casing element (1) and the metal sheets 9(A) and 9(B) which are joined to casing element 1 by connector tabs 20 and 21 and open at their upper and lower ends to the vertical air flow formed on the outside of the core (6) when the electric resistors (7) are activated and causing a thermal unbalance of the surrounding air mass. When air flow (17) starts through heater core (6), the through-flow of room-air (18) also starts through channel (8) between casing elements (1) and metal sheets (9A) and (9B) with a temperature lowering effect on the casing elements (1). The feet (11) determine the distance to the floor surface. Through the bottom grille (10) room-air can enter the heater core (6) and flow out through the top heated air discharge grille (12). The electric resistor (7) is connected to the electric power supply by a lead (13) furnished with a switch (14), a thermostat (15) and a plug (16). The separating wall (4) can also be formed of the one vertical side of each of the metal sheet: (9A) and (9B) as shown in FIG. 5. On heating the heater, the combination casing element (1) and steel sheets (9A) and (9B) form a radiating cell in which the surface turned towards the resistor (7) becomes heat generating and radiation reflecting and the casing element (1) towards the room becomes a channel wall for the air convecting heat from the metal sheets (9A) and (9B). The portion of radiation which the metal sheets (9A) and (9B) cannot use, is directed diagonally downward through the bottom grille (10) to the floor under the heater. The floor gets warmed-up and causes then an air-flow against the bottom grille (10).

Many variations are possible within the limits of the invention.

I claim:

1. An electric space heater with thermal self-circulation of room-air heated by means of electric resistors placed in a core of the heater comprising:

a heater casing comprising at least three vertical casing elements being arranged as outer walls which define a central core open at top and bottom, adjacent vertical side edges of said casing elements being spaced apart to define open corner air slots;

inner walls joined to said casing elements at said vertical side edges to form vertical air flow passages therebetween, each of said passages having an open top and bottom, said inner walls comprising sheets having horizontally adjacent edges offset to form air slots through which air in said passages flows into said central core;

vertical baffles at said open corner air slots for diverting air entering said open corner air slots into said passages.

2. The electric space heater according to claim 1 wherein said heater casing comprises three casing elements which form a triangular-shaped heater.

* * * * *